US007328090B2

(12) United States Patent
Pachl

(10) Patent No.: US 7,328,090 B2
(45) Date of Patent: Feb. 5, 2008

(54) METHOD FOR CONTROLLING THE SEQUENCE OF TRAINS DURING TRAFFIC CONTROL

(75) Inventor: Jörn Pachl, Braunschweig (DE)

(73) Assignee: Siemens AG, Munich (DE)

( * ) Notice: Subject to any disclaimer, the term of this patent is extended or adjusted under 35 U.S.C. 154(b) by 192 days.

(21) Appl. No.: 10/546,717

(22) PCT Filed: Jan. 21, 2004

(86) PCT No.: PCT/DE2004/000097

§ 371 (c)(1),
(2), (4) Date: Aug. 24, 2005

(87) PCT Pub. No.: WO2004/076258

PCT Pub. Date: Sep. 10, 2004

(65) Prior Publication Data

US 2006/0161317 A1 Jul. 20, 2006

(30) Foreign Application Priority Data

Feb. 25, 2003 (DE) ..... 103 09 200

(51) Int. Cl.
*G06D 1/00* (2006.01)

(52) U.S. Cl. ..... 701/19; 701/20

(58) Field of Classification Search ..... 701/1, 701/19, 20, 29, 300, 301; 246/167 R, 187 A, 246/187 C; 706/1–10
See application file for complete search history.

(56) References Cited

U.S. PATENT DOCUMENTS 6,505,104 B2 * 1/2003 Collins ..... 701/19
6,760,712 B1 * 7/2004 Bonissone et al. ..... 706/4
6,799,098 B2 * 9/2004 Horst et al. ..... 701/19

FOREIGN PATENT DOCUMENTS

| | | | |
|---|---|---|---|
| DE | 41 07 639 | A1 | 9/1992 |
| DE | 198 44 263 | A | 4/1999 |
| DE | 100 03 971 | A1 | 10/2001 |
| EP | 0 076 672 | A | 4/1983 |
| EP | 1 396 413 | A1 | 3/2004 |
| WO | WO 96/21590 | A | 7/1996 |

OTHER PUBLICATIONS

Jean-Pierre Gide, Jose Banaudo: "Les Trains du Mont-Blnc, Premier volume", 1998, Les Editions du Cabri, S. 94, Spalte 1, Abs. 3—Seitee95, Spalte 1, Abs. 2.
Materne H. et al. "Funkgestützte integrale Leit-, Informations- und Sicherungstechnik für Regionalbahnen", Zeitschrift für Eisenbahnwesen und VerkehstechnikBd. 120, Nr. 11/12, Nov. 1, 1996, Seiten 461-467.
Ganz R: "Sicherungs des Bahnbetriebs auf Strecken mit schwachen bis Mäßigen Verkehr", Elektrische Bahnen, Oldenbourg Verlag, München, Bd. 100, Nr. 11, Nov. 2002, Seiten 428-433.

* cited by examiner

*Primary Examiner*—Richard M. Camby
(74) *Attorney, Agent, or Firm*—LAurence A. Greenberg; Werner H. Stemer; Ralph E. Locher

(57) ABSTRACT

The invention relates to a method for controlling the sequence of trains during traffic control, whereby a telephone communication between a traffic controller in a traffic control centre and a driver is carried out. In order to increase security during telephone communication, the traffic controller transmits a driving permit to the driver, in addition to a test code which is specific to the driving permit and determined by a traffic control computer, and the driver inputs the driving permit and the test code into a vehicle appliance which calculates the test code according to the same algorithm as the traffic control computer, and compares the calculated test code with the inputted test code. The driving permit is authenticated only if the two codes correspond.

5 Claims, 2 Drawing Sheets

METHOD FOR CONTROLLING THE SEQUENCE OF TRAINS DURING TRAFFIC CONTROL

Figure 1:
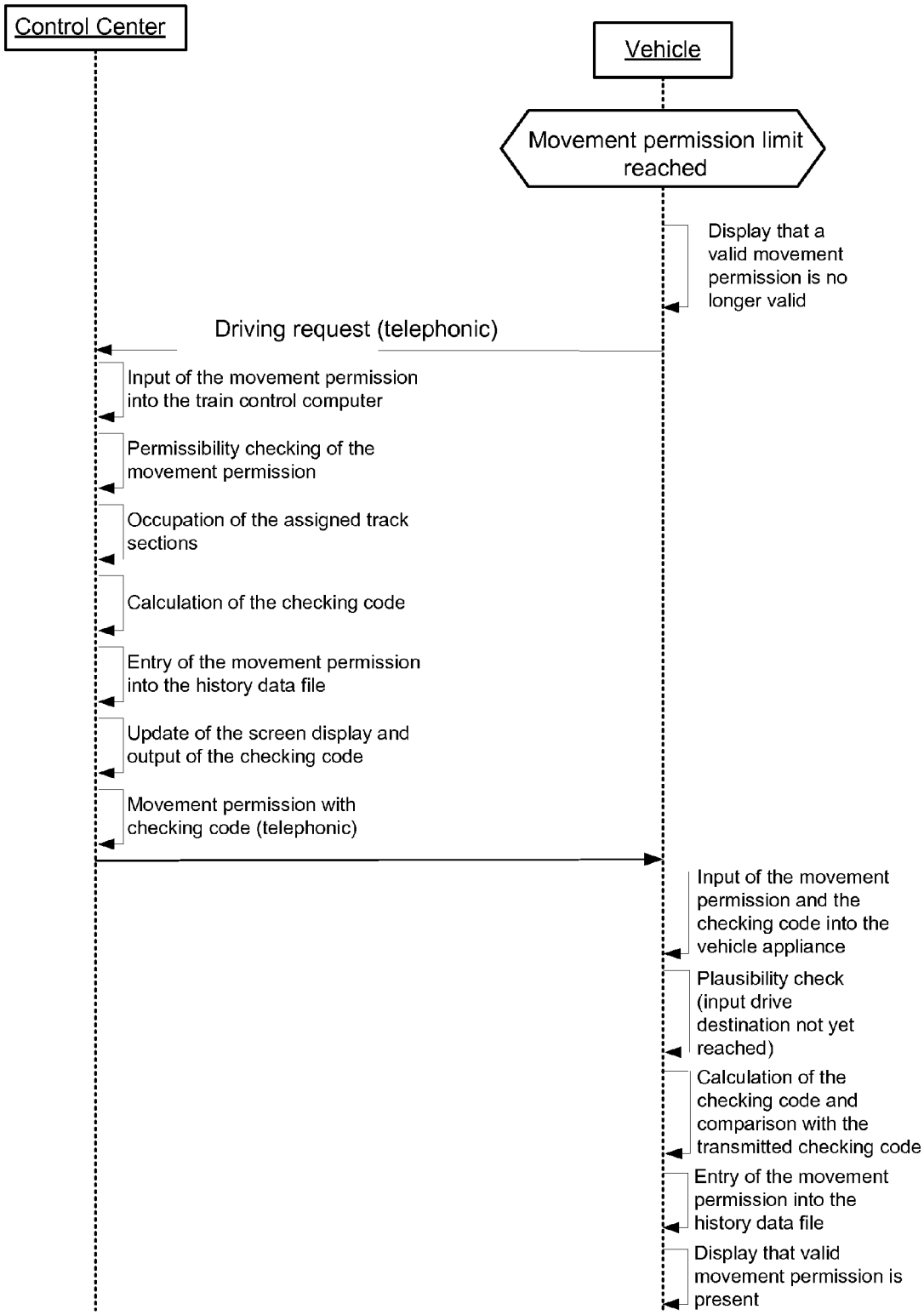

The invention relates to a method for controlling the sequence of trains during traffic control, as claimed in the precharacterizing clause of claim 1, and to an apparatus relating to this as claimed in the precharacterizing clause of claim 3.

On sections with a small amount of traffic, the sequence of trains is frequently controlled using traffic control. In this case, the train controller controls train movements and shunting operations on an associated train control section with train running messages and other messages. The train controller maintains a train logbook, in which the operating state of the train control section are entered, that is to say the movement permissions which are transmitted by telephone to the locomotive engineers in order to move on the train control section. Owing to the lack of technical protection, only low speeds are permissible in traffic control in particular up to 60 km per hour and, if specific preconditions are satisfied, up to 80 km per hour. Train running tracking is carried out in traffic management only in the form of the train logbook, which is maintained in a handwritten form. No computer-aided train running data is available for linking to other information and disposition systems.

The invention is based on the object of overcoming these disadvantages and of specifying a method of the type mentioned initially which allows a safety supplement to traffic control, with little technical complexity.

The object is achieved by the characterizing features of claim 1. The introduction of the checking code which is specific to the movement permission technically precludes the transmission of a movement permission for which the safety preconditions are not satisfied. Furthermore, compliance with the movement permission is monitored technically on the locomotive. The checking code guarantees technical protection of the telephone communication, thus ensuring that the train controller cannot grant movement permission which he has not previously checked for permissibility by an input in the train control computer, and also that the locomotive engineer does not receive confirmation for movement permission when he enters movement permission which he has not previously received, or has not received in this form, in the vehicle appliance. The checking code is calculated from the data for the current operating situation by means of an algorithm which cannot be coped with manually. In this case, it is, of course, necessary to ensure that the checking codes cannot be repeated with a regularity which can be understood. The improvement in safety associated with this allows approval for speeds of up to 100 km/h.

The train controller has a train control computer in the train control center in which—instead of or in addition to the train logbook—all train running messages are entered and in which there is thus a database relating to the current operating situation on the train control section all the time. Every movement permission must be entered in the train control computer before being transmitted by telephone to the locomotive engineer. The input can be made in the most effective manner, in a similar manner to that for routing, by definition of the start and destination. The train control computer carries out a permissibility check and rejects the movement permission in the event of a safety-critical conflict. The train control computer does not determine any checking code for a rejected movement permission.

There is a single vehicle appliance onboard the locomotive. The movement permission which is transmitted by telephone from the train controller to the locomotive engineer is entered in the vehicle appliance together with the checking code by the locomotive engineer. The vehicle appliance checks the correctness of the entered movement permission, and compares the movement destination with the current train location. If there are no objections to the movement permission, this is indicated on the vehicle appliance display as a valid movement permission, otherwise the vehicle appliance rejects it. On reaching the movement permission boundary, that is to say the movement destination, for which the movement permission was granted, the locomotive engineer is instructed by an indication, and possibly by an audible signal, to obtain a new movement permission. If the movement permission boundary is crossed, a warning signal is produced demanding that the locomotive engineer stop immediately.

When the locomotive engineer enters the movement permission (which is being transmitted by telephone by the train controller) in the vehicle appliance, the checking code which is likewise transmitted must also be entered. The vehicle appliance uses the same algorithm as the train control computer to calculate the checking code for every movement permission that is entered, and compares this with the checking code entered by the locomotive engineer. If the manually entered checking code does not match the calculated checking code, the movement permission is rejected. Since the locomotive engineer cannot determine the checking code himself and is thus instructed to enter a valid movement permission in response to the transmission of the checking code by the train controller, it is impossible for an incorrectly entered movement permission whose permissibility has not already been checked in the train control center and for which there is thus a checking code to obtain confirmation of this movement permission, that is to say a valid movement permission.

As is claimed in claim 2, a similar safety process is also provided for the transmission of a train running message from the locomotive engineer to the train controller. Before emission of the train running message, which is intended for producing the safety release of track sections in front, this message is first of all entered by the locomotive engineer in the vehicle appliance, which calculates the associated checking code. The locomotive engineer then transmits the train running message together with the checking code to the train controller, who enters both data records in the train control computer. The train control computer uses the same algorithm as the vehicle appliance to calculate the checking code for each entered train running message, and compares this with the manually entered checking code. If the entered checking code does not match the calculated checking code, the train running message is rejected. Since the train controller cannot determine the checking code himself and is thus instructed to enter a valid train running message in response to the transmission of the checking code by the locomotive engineer, it is impossible for an associated track section to be released erroneously.

The transmission of a train running message from a local train station movement manager to the train controller would likewise have to be provided, if required, in a similar manner.

According to claim 3, the following components are required as major items for an apparatus for carrying out the method:

a train control computer in the train control center for permissibility checking and for calculation of the checking code a communication device between the train control center and the locomotive, as well as a vehicle appliance for calculation of the checking code which is specific to the movement permission, and having a comparison device for comparison of the manually entered checking code with the calculated checking code.

Only a relatively small number of new infrastructure components are therefore required for sections on which there is little traffic. Communication in this case takes place via the existing communication technique. An improvement in safety is also obtained by not equipping all of the locomotives with the vehicle appliance. Although there may be certain operational restrictions, in particular with regard to speed restrictions, there is, however, no need for any complex technical additional devices in the train control center.

According to claim 4, the train control computer is preferably a computer which is safe for signaling purposes and has history functions. This solution which is safe for signaling purposes is the only way to make it possible to dispense with the management of the handwritten train logbook for traffic control. In order to allow operation to continue using a handwritten train logbook in the event of failure of the train control computer, the train control computer must have a protected history function, from which the operating situation that existed immediately before the failure together with all the train locations and the movement permissions that have been granted can be called up and can be transmitted to the train logbook.

The choice of a solution which is safe for signaling purposes would also allow the train control computer to be integrated in the control interface for electronic control systems. It would thus be possible to control not only sections controlled by the control system but also train control sections from one user interface. The database for the train control computer also allows linking to disposition systems, that is to say it is also possible to integrate regional networks in the disposition of sections controlled by a control system and train control sections in a system, even in the operational control centers.

According to one preferred embodiment, which is characterized in claim 5, the vehicle appliance is in the form of a computer which is not safe for signaling purposes but has a history function. The vehicle computer does not grant the locomotive engineer direct clearance to move, but has only a restrictive effect on operation when faults are found. Failure of the vehicle appliance on its own cannot lead to any hazard. An incorrect action by the locomotive engineer must always take place for this to occur. In consequence, it is sufficient to use a solution which is not safe for signaling purposes and is thus technically less complex. Nevertheless, it should be possible to record all indications and inputs of the vehicle appliance for subsequent evaluation processes by means of history functions, in the event of irregularities.

If local train station movement managers are equipped with computers for calculation of the checking codes, similar requirements apply to those for the vehicle appliances. However, these computers may possibly not need any protected history function.

Figure 2:
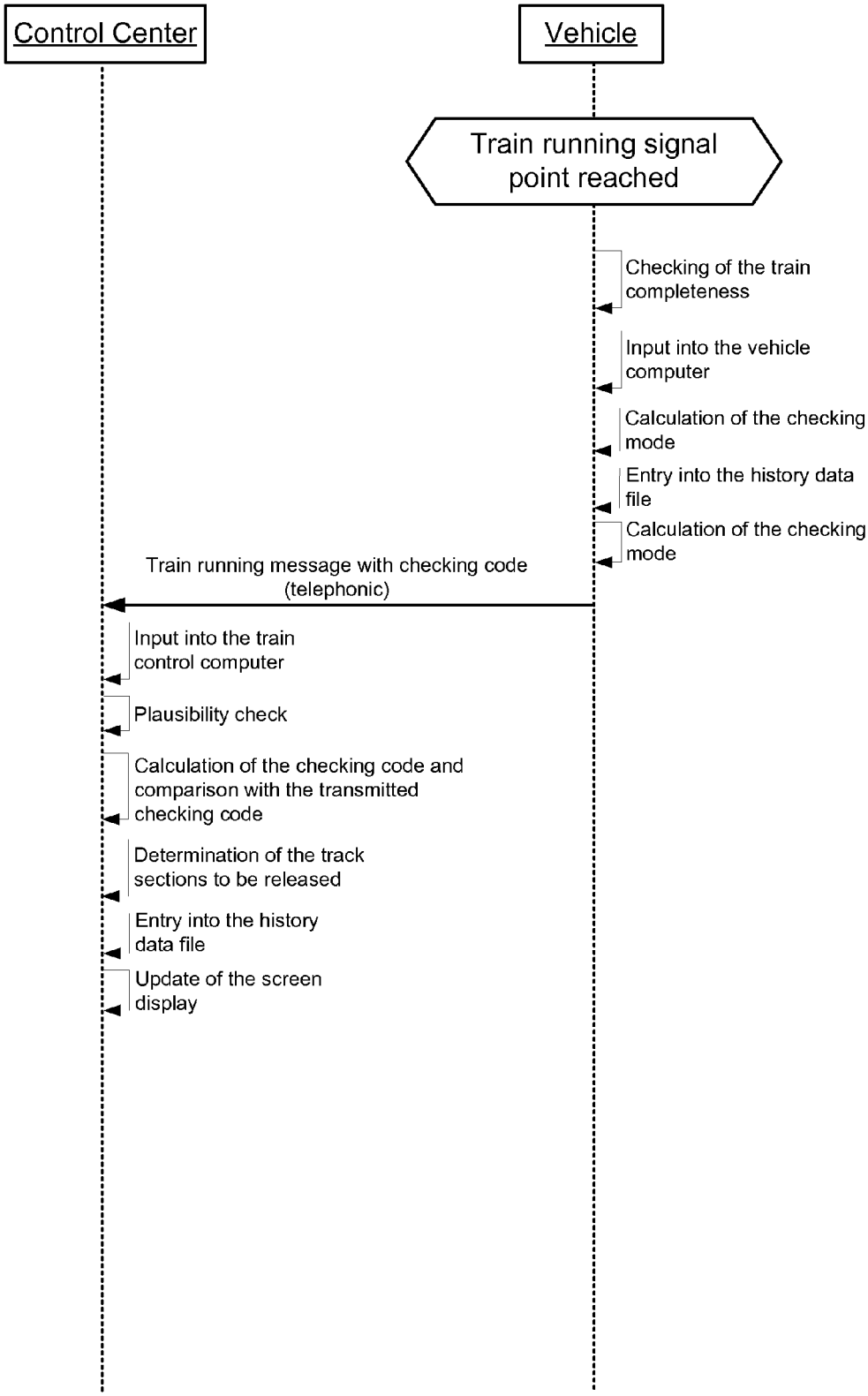

The invention will be explained in more detail in the following text with reference to illustrations in the form of figures, in which:

FIG. 1 shows a schematic illustration relating to the transmission of movement permission from a train controller to a locomotive engineer, and FIG. 2 shows a schematic illustration relating to the transmission of a train running message from the locomotive engineer to the train controller.

FIG. 1 shows the procedure used by a control center to grant movement permission to a vehicle. Once a train controller in the control center has received a movement request, transmitted by telephone from a vehicle engineer, the train controller enters an appropriate movement permission in a train computer. This uses the occupancy status of the requested track section to check the permissibility of the movement permission, and calculates a checking code which is specific for that movement permission. The movement permission is then stored in a history file in the train control computer, and is quasi-granted, together with the checking code, on a train control computer screen display. This movement permission is transmitted by the train controller together with the checking code by telephone to the vehicle engineer. The vehicle engineer enters the movement permission and the checking code in a vehicle appliance, which carries out a plausibility check, in particular relating to the current vehicle position and destination, and determines the checking code on a permission specific basis analogously to the train control computer. Once this has been done, the movement permission is stored in a history file in the vehicle appliance, and is displayed as a valid movement permission.

The calculation of the checking code may include, in particular, details relating to the date, train number and destination of the movement permission.

This results in a safety level being achieved which is comparable to that for train sequence protection on sections with a section block which is not autonomous, without any train influence. Step-by-step implementation is also possible, by restricting the protection of the transmission of messages to the granting of the movement permission as shown in FIG. 1. The largest safety gap in traffic control is thus closed just by prevention of impermissible departure without any movement permission.

FIG. 2 shows the procedure for the train running message from the vehicle engineer to the control center. If the vehicle has reached one of possibly a number of train running signaling points within a train control section for which that control center is responsible, the train completeness is first of all checked, and is entered in the vehicle computer. This calculates the checking code, which is also stored in the history file. The checking code is displayed and is transmitted together with the train running message by telephone to the train controller in the control center. The train running message and checking code are entered in the train control computer, which carries out a plausibility check, likewise calculates the checking code, and compares this with the manually entered checking code. The track sections to be released are then defined and are entered in the history file. The screen display confirms the correctness of the train running message or, if appropriate, signals a fault state.

The calculation of the checking code for the train running message may, in particular, include the date, the train number, the nature of the train running message and the current train running signaling point.

The invention is not restricted to the exemplary embodiments described above. In fact, a number of variants are feasible, which also make use of features of the invention, while being implemented in fundamentally different forms.

The invention claimed is:

1. A method for controlling the sequence of trains during traffic control, with communication taking place between a train controller in a train control center and a locomotive engineer, wherein the train controller transmits movement permission to the locomotive engineer and a movement-permission-specific checking code, which is determined by a train control computer, and the locomotive engineer enters the movement permission and the checking code in a vehicle appliance which uses the same algorithm as the train control computer to calculate the checking code, and compares the calculated checking code with the entered checking code, with the movement permission being confirmed only in the event of a match, and rejection of the movement permission being signaled if there is no match; and wherein the locomotive engineer transmits to the train controller a train running message, which is required in order to release a track section, and a checking code which is determined by the vehicle appliance and is specific to the train running message, and the train controller enters the train running message and the checking code in the train control computer, which uses the same algorithm as the vehicle appliance to calculate the checking code and compares the calculated checking code with the entered checking code, and the track section is released only in the event of a match.

2. An apparatus for carrying out the method as claimed in claim 1, wherein a train control computer which is arranged in the train control center and has a checking apparatus for permissibility checking of movement permission which can be entered manually for a train control section on the basis of the current operating situation on this train control section, in which case a calculation device for calculation of a checking code which is specific to the movement permission can be activated only if the movement permission is permissible, a communication device for telephone transmission of the movement permission and of the checking code to the locomotive engineer, and a vehicle appliance which is arranged on the locomotive and has a location device, the calculation device for calculation of the checking code which is specific to the movement permission and a comparison device for comparison of the calculated checking code with the checking code which was transmitted by telephone and can be entered manually together with the movement permission, with a display being provided for visualization of the comparison results.

3. The apparatus as claimed in claim 2, wherein the train control computer is a computer which is safe for signaling purposes and has a history function.

4. The apparatus as claimed in claim 2 wherein the vehicle appliance is a computer which is not safe for signaling purposes but has a history function.

5. A method for controlling a sequence of trains during traffic control, the method which comprises:

determining, with a train control computer using a given algorithm, a movement-permission-specific checking code;

transmitting, from a train controller to a locomotive engineer, a movement permission and the movement-permission-specific checking code;

entering the movement permission and the checking code in a vehicle appliance, calculating the checking code in the vehicle appliance with the given algorithm to form a calculated checking code, and comparing the calculated checking code with the entered checking code;

confirming the movement permission only in the event of a match, and signaling a rejection of the movement permission if there is no match; and transmitting a running message and an associated checking code from the locomotive engineer to the train controller, with the train running message being required in order to release a track section and the associated checking code being determined by the vehicle appliance and being specific to the train running message;

entering the train running message and the associated checking code in the train control computer, using the same algorithm as the vehicle appliance to calculate a calculated checking code, and comparing the calculated checking code with the entered checking code; and releasing the track section only in the event of a match between the calculated checking code and the entered checking code.

* * * * *